US009028300B2

(12) United States Patent
Ahn et al.

(10) Patent No.: US 9,028,300 B2
(45) Date of Patent: May 12, 2015

(54) GRINDING TOOL ADAPTED TO COLLECT GRINDING PARTICLES

(75) Inventors: Jang-Hyuk Ahn, Hwaseong-si (KR); Jong-Kook Yeom, Daejeon (KR)

(73) Assignee: Ehwa Diamond Industrial Co., Ltd., Gyunggi-Do (KR)

( * ) Notice: Subject to any disclaimer, the term of this patent is extended or adjusted under 35 U.S.C. 154(b) by 400 days.

(21) Appl. No.: 13/524,204

(22) Filed: Jun. 15, 2012

(65) Prior Publication Data

US 2013/0052922 A1 Feb. 28, 2013

(30) Foreign Application Priority Data

Aug. 31, 2011 (KR) ..... 10-2011-0087818
Oct. 25, 2011 (KR) ..... 10-2011-0109451

(51) Int. Cl.
*B24B 55/06* (2006.01)
*B24D 7/06* (2006.01)
*B24D 7/10* (2006.01)

(52) U.S. Cl.
CPC ... *B24D 7/06* (2013.01); *B24D 7/10* (2013.01)

(58) Field of Classification Search
CPC ..... B24B 55/102; B24B 55/06; B24B 55/04; B24B 55/052; A43D 95/08; B24D 7/06; B24D 7/10
USPC ..... 451/344, 358, 359, 456, 488, 548
See application file for complete search history.

(56) References Cited

U.S. PATENT DOCUMENTS

| | | | | |
|---|---|---|---|---|
| 5,105,585 | A * | 4/1992 | Hampl et al. | 451/359 |
| 5,911,620 | A * | 6/1999 | Spangenberg et al. | 451/548 |
| 6,299,522 | B1 | 10/2001 | Lee | |
| 6,527,634 | B2 * | 3/2003 | Lee et al. | 451/548 |
| 6,551,181 | B2 * | 4/2003 | Lee | 451/548 |
| 6,811,476 | B2 * | 11/2004 | Ohlendorf | 451/456 |
| 6,814,657 | B2 * | 11/2004 | Spangenberg et al. | 451/548 |
| 6,926,583 | B2 * | 8/2005 | Nussbaumer et al. | 451/5 |
| 7,147,549 | B2 * | 12/2006 | Valentini | 451/456 |
| 7,458,884 | B2 * | 12/2008 | Falk | 451/359 |
| 8,764,518 | B2 * | 7/2014 | McCutchen et al. | 451/359 |
| 2007/0232206 | A1 | 10/2007 | Shorrock et al. | |

FOREIGN PATENT DOCUMENTS

| | | | |
|---|---|---|---|
| KR | 2000-0017712 | A | 4/2000 |
| KR | 2009-0086307 | A | 8/2009 |
| KR | 2011-0094531 | A | 8/2011 |

OTHER PUBLICATIONS

International Search Report for corresponding International Application No. PCT/KR2012/004725 mailed Dec. 6, 2012.

* cited by examiner

*Primary Examiner* — Timothy V Eley
(74) *Attorney, Agent, or Firm* — Renner, Otto, Boisselle & Sklar, LLP

(57) ABSTRACT

Disclosed is a grinding tool, which includes a first disk having an installation hole in a center portion thereof such that the grinding tool is installed on a grinder, a second disk forming a discharge passage with partitions on a bottom surface of the first disk, wherein air intaken from a central lower portion of the grinding tool is discharged to an outside thereof through the discharge passage, and a ring-shaped shank disposed under the second disk and including grinding tips to grind a target.

16 Claims, 10 Drawing Sheets

(a)

(b)

(a)

(b)

GRINDING TOOL ADAPTED TO COLLECT GRINDING PARTICLES

CROSS-REFERENCE TO RELATED APPLICATIONS

This application claims the priority of Korean Patent Applications No. 10-2011-0087818 filed on Aug. 31, 2011 and No. 10-2011-0109451 filed on Oct. 25, 2011, in the Korean Intellectual Property Office, the disclosure of which is incorporated herein by reference.

BACKGROUND OF THE INVENTION

1. Field of the Invention

The present invention relates to a grinding tool for grinding a target, and more particularly, to a grinding tool adapted to collect grinding particles produced while grinding a target.

2. Description of the Related Art

In general, a grinding tool is used to grind various materials (hereinafter, referred to as grinding targets) such as granite, tiles, bricks, and concrete blocks, and grinding parts thereof may be variously shaped, such as having a wheel or planar shape, to grind inner and outer surfaces of a grinding target.

A grinding wheels is a typical grinding tool.

Such a grinding wheel includes a shank having a circular plate shape, and grinding tips provided on the shank to substantially perform a grinding operation.

In this case, the grinding tips are provided in the form of a sintered body that includes diamond, carbon nitride (CBN), or a typical abrasion material (hereinafter, referred to as an abrasion material in general) mixed with powder (hereinafter, referred to as a bond) formed of metal, resin, or ceramic to hold the abrasion material and continually ensure the performance thereof.

The grinding tips are attached to the shank through a process such as welding, soldering, or bonding, and is rotated together with the shank to grind a target.

Typical grinding tools such as grinding wheels produce a large amount of grinding particles while grinding a grinding target. These grinding particles may be re-introduced into a working site where the grinding target is ground, so as to degrade grinding efficiency, or may be discharged to the area surrounding the working area to thereby contaminate it. Furthermore, grinding particles are harmful to the human body. Thus, decreasing the amount of such grinding particles discharged during a grinding operation is constantly required.

To this end, a vacuum suction device may be disposed at a side of a grinding wheel to remove grinding particles. Recently, a method of collecting grinding particles by using power of power tools has been introduced.

FIG. 1 is a plan view illustrating a grinding wheel in the related art. FIG. 2 is a cross-sectional view illustrating the grinding wheel of FIG. 1. Referring to FIGS. 1 and 2, a grinding wheel 10 includes: a shank 12 in the central portion thereof, which is installed in a power tool such as a grinder (not shown) and which has an installation hole; and a plurality of grinding tips 20 disposed on the shank 12 to substantially grind a target.

The grinding tips 20 are arrayed around the shank 12, and the shank 12 is installed on the grinder. The grinding tips 20 contact a target, and rotate to grind the target. The grinding tips 20 may be provided in various forms, and may be arrayed in various formations, e.g., by using single, double, and turbo attachment methods.

The shank 12 is provided with holes 14 for removing or intaking particles generated during a grinding operation.

Intake efficiency of the shank 12 may depend on a shape, orientation, or arrangement of the holes 14.

As the shank 12 rotates, particles generated during a grinding operation are intaken through the holes 14.

The grinder includes a dust cover (not shown) for collecting grinding particles intaken through the holes 14, and a particle collector for providing suction force.

However, a large amount of particles produced from a grinding target may not be intaken into the particle collector, and may be discharged to the outside of the grinding wheel 10 by centrifugal force, which degrades particle collecting efficiency and usage efficiency of the grinding wheel 10.

Moreover, as the size or rotation speed of grinding wheels increases, the amount of grinding particles discharged without being intaken into a particle collector increases. Thus, research and development of efficiently collecting grinding particles is needed.

SUMMARY OF THE INVENTION

An aspect of the present invention provides a grinding tool having an improved structure to efficiently intake grinding particles produced while grinding a target.

According to an aspect of the present invention, there is provided a grinding tool including: a first disk having an installation hole in a center portion thereof such that the grinding tool is installed on a grinder; a second disk forming a discharge passage with partitions on a bottom surface of the first disk, wherein air intaken from a central lower portion of the grinding tool is discharged to an outside thereof through the discharge passage; and a ring-shaped shank disposed under the second disk and including grinding tips to grind a target.

The grinding tool may further include an intake recess in at least one of the second disk and the shank to take air in, wherein the shank has at least one air intake hole that communicates with the intake recess to introduce the air to the central portion of the grinding tool.

The intake recess may have a predetermined curvature in a direction of rotation of the grinding tool.

The partition may have a predetermined curvature in a direction of rotation of the grinding tool.

The grinding tips may have a predetermined curvature in a direction of rotation of the grinding tool.

The grinding tool may further include an auxiliary partition between the partitions.

The grinding tool may further include a dust cover that separates the partition and the intake recess from each other, and covers an outlet of the discharge passage.

The grinding tool may further include a particle collecting part that communicates with a portion of the dust cover.

The dust cover may include a guide cover to cover the intake recess, and have a hole in a portion thereof such that a portion of air discharged from the discharge passage is introduced into a space formed by the guide cover.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
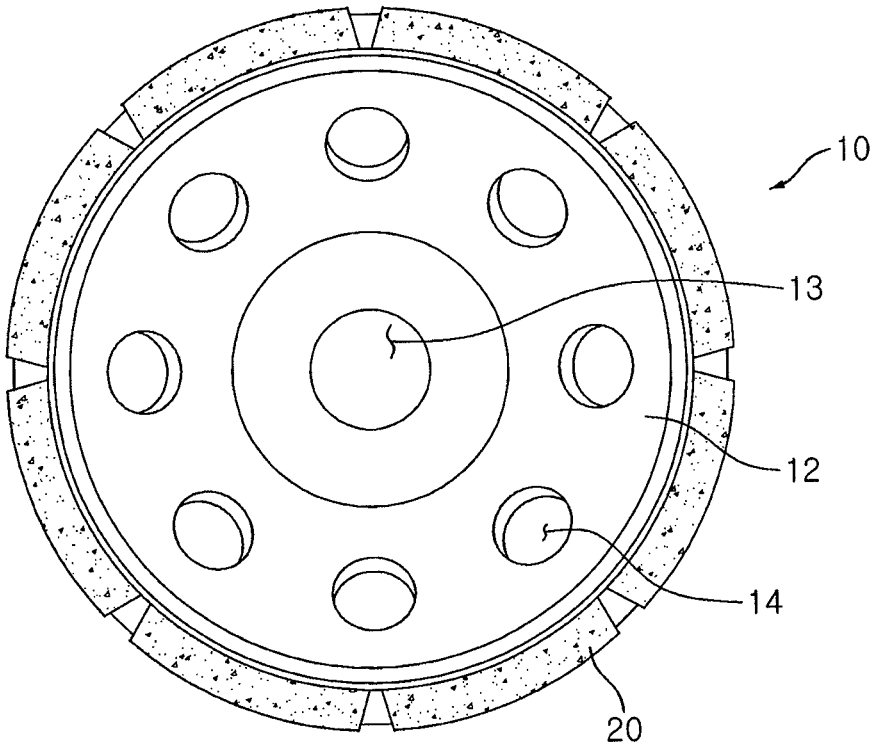
PRIOR ART FIG. 1
FIG. 1 is a plan view illustrating a grinding wheel in the related art.
Figure 2:
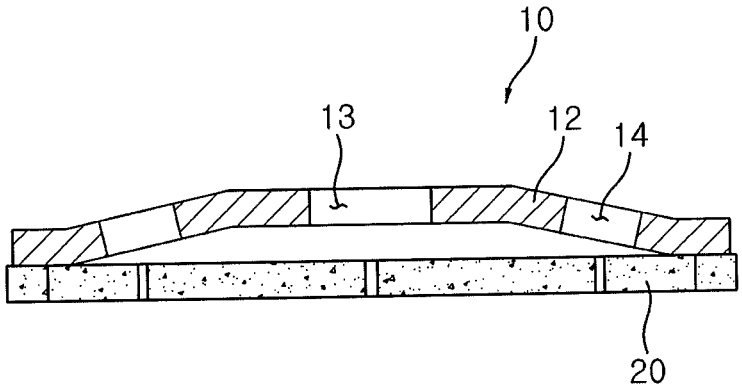
PRIOR ART FIG. 2
FIG. 2 is a cross-sectional view illustrating the grinding wheel of FIG. 1.

Exemplary embodiments of the present invention will now be described in detail with reference to the accompanying drawings. The invention may, however, be embodied in many different forms and should not be construed as being limited to the embodiments set forth herein. In the drawings, the shapes and sizes of elements are exaggerated for clarity. Like reference numerals in the drawings denote like elements.

Figure 3:
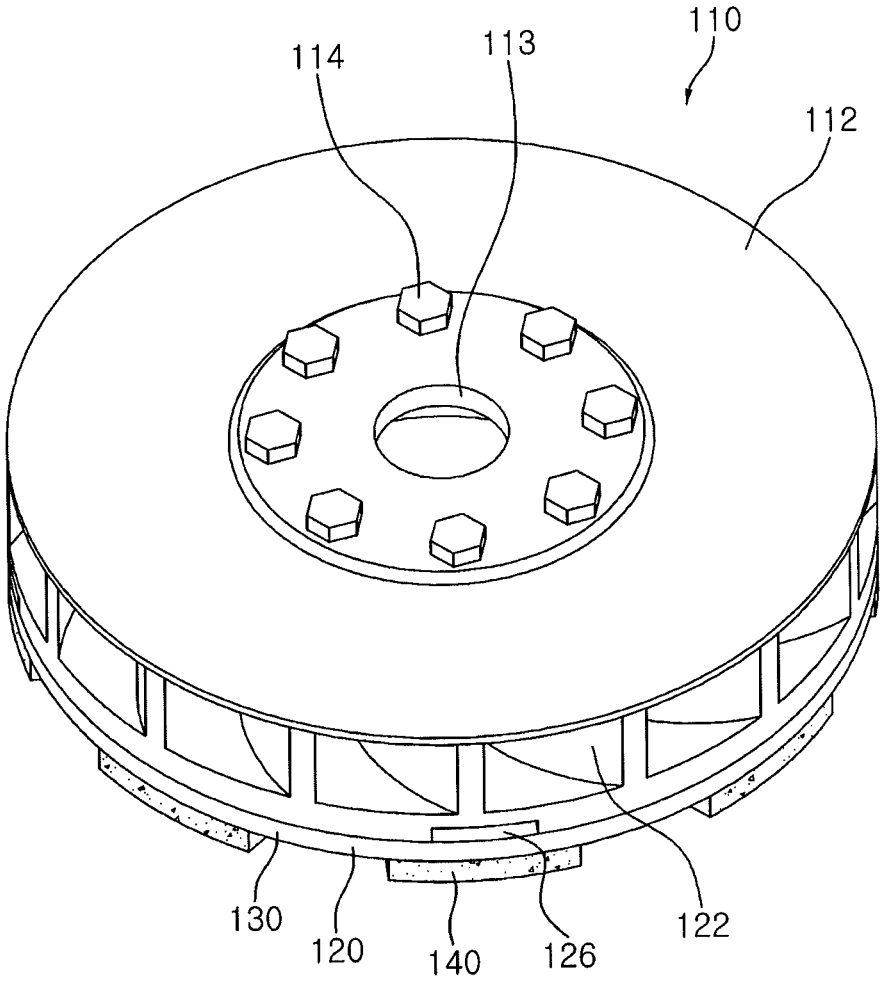
FIG. 3 is a perspective view illustrating a grinding wheel according to an embodiment of the present invention.
Figure 4:
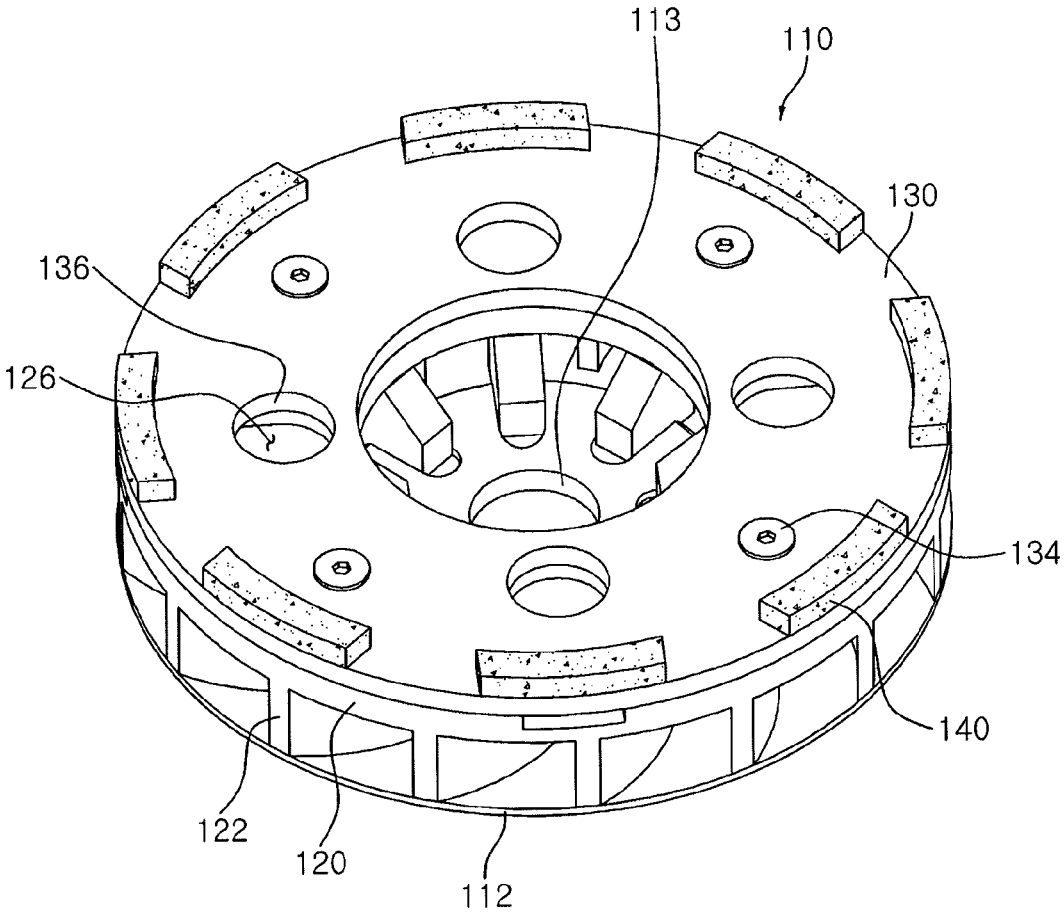
FIG. 4 is a perspective view illustrating the bottom of the grinding wheel of FIG. 3.
Figure 5:
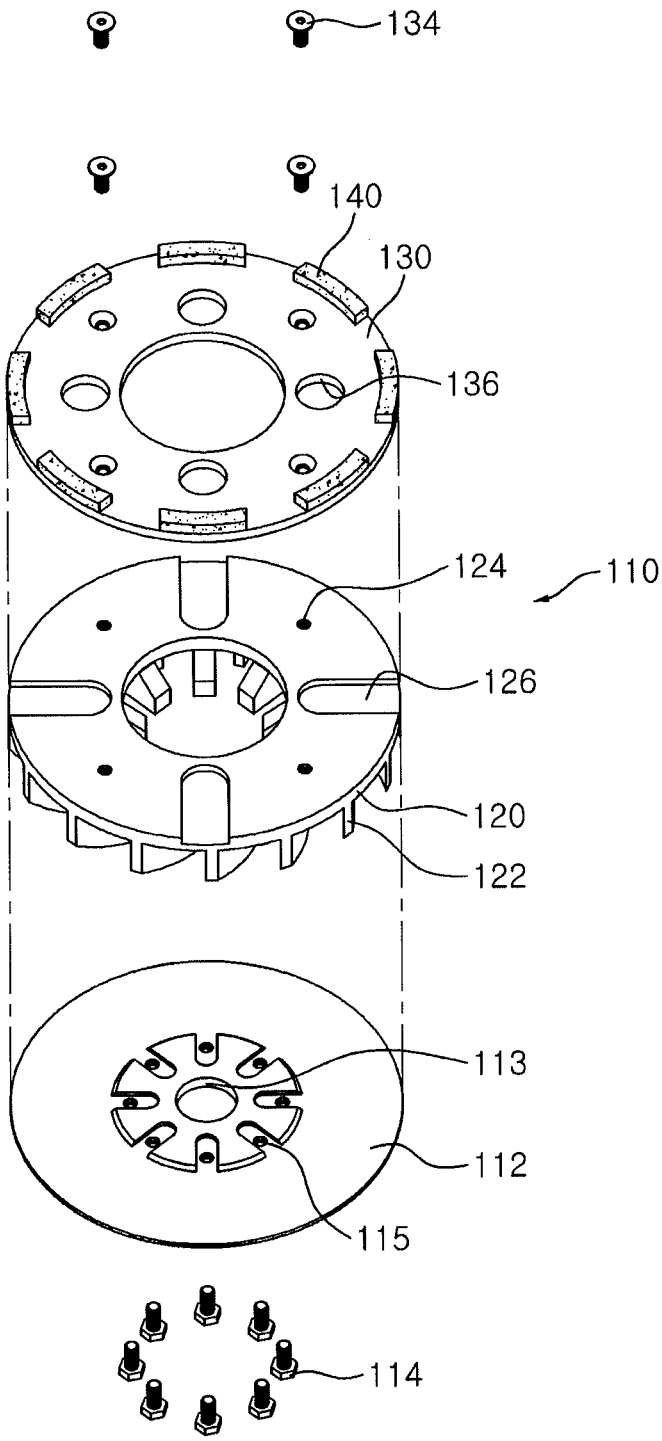
FIG. 5 is an exploded perspective view illustrating the grinding wheel of FIG. 3.
Figure 6:
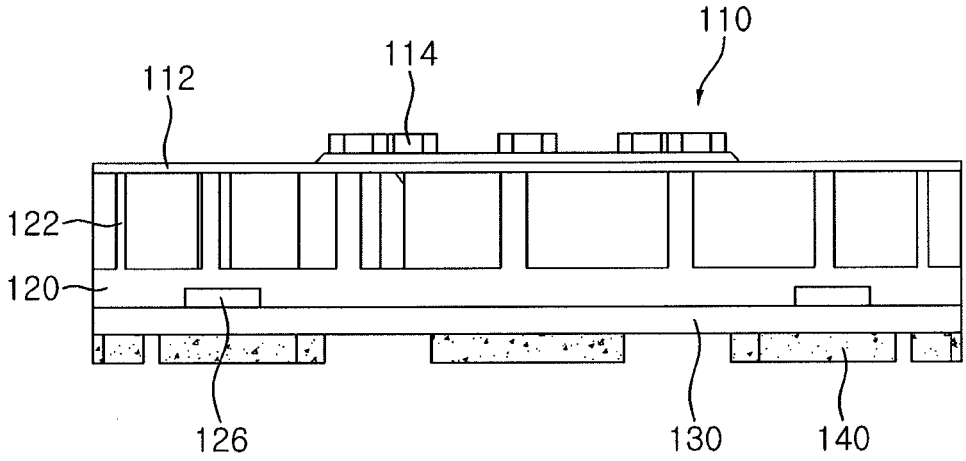
FIG. 6 is a front view illustrating the grinding wheel of FIG. 3.
Figure 7:
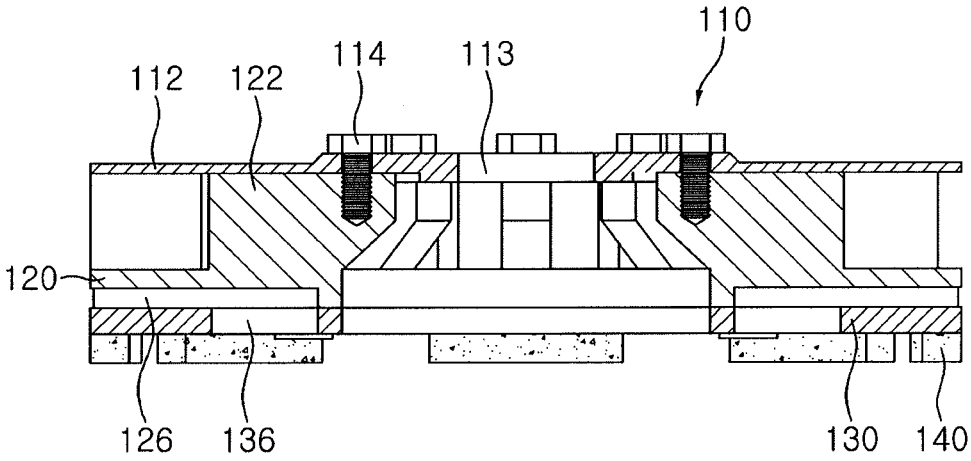
FIG. 7 is a cross-sectional view illustrating the grinding wheel of FIG. 3.

FIG. 3 is a perspective view illustrating a grinding wheel according to an embodiment of the present invention. FIG. 4 is a perspective view illustrating the bottom of the grinding wheel of FIG. 3. FIG. 5 is an exploded perspective view illustrating the grinding wheel of FIG. 3. FIG. 6 is a front view illustrating the grinding wheel of FIG. 3. FIG. 7 is a cross-sectional view illustrating the grinding wheel of FIG. 3.

Referring to FIGS. 3 to 7, a grinding tool is installed on a power tool such as a grinder to rotate or move linearly, thereby abrading and grinding a grinding target.

The grinding tool according to the current embodiment, as a separate part, is installed on the grinder as a power tool, but is not limited thereto. Thus, the grinding tool may be integrated into a grinder as a power tool, according to various embodiments.

A grinding wheel 110 is exemplified as the grinding tool according to the current embodiment, which has a circular shape and rotates to grind a target.

The grinding wheel 110 may include a first disk 112 that has an installation hole 113 in the central portion thereof, so that the grinding wheel 110 can be installed on the grinder.

A second disk 120 may be disposed on the bottom surface of the first disk 112.

A plurality of partitions 122 may be disposed on the top surface of the second disk 120, and be coupled to the bottom surface of the first disk 112. Furthermore, the partitions 122 may extend outwardly from the center of the second disk 120. Accordingly, the distance between the partitions 122 may increase from the center of the second disk 120 to the edge thereof.

The second disk 120 may have a circular shape with a through hole in the central portion thereof.

As such, the partitions 122, the bottom surface of the first disk 112, and the top surface of the second disk 120 may form a certain space within the grinding wheel 110. Centrifugal force generated according to a rotation of the grinding wheel 110, and vacuum pressure generated according to the increase of the distance between the partitions 122 may discharge air from the inside of the grinding wheel 110 to the outside thereof.

Thus, when the grinding wheel 110 rotates, the space formed by the partitions 122, the bottom surface of the first disk 112, and the top surface of the second disk 120 may function as a discharge passage through which air introduced from the lower side of the grinding wheel 110 through the through hole of the second disk 120 is discharged to the outside.

The partitions 122 may be integrated into the second disk 120, and may be coupled to the first disk 112 by coupling members 114, such as bolts coupled to the partitions 122 or the second disk 120.

However, a method of coupling the partitions 122 to the first disk 112 is not limited to the coupling members 114, and thus, various methods such as welding, press-fitting, and removable coupling may be used.

Coupling holes 115 into which the coupling members 114 are inserted may be formed in one of the first disk 112 and the second disk 120 to couple the partitions 122 to the first disk 112. In this case, the coupling members 114 may be coupled to coupling parts 125 (refer to FIG. 9) formed in the other of the first disk 112 and the second disk 120, or be coupled to members such as nuts.

A shank 130 having a ring shape with a through hole in the central portion thereof may be disposed under the second disk 120. Grinding tips 140 for grinding a target may be disposed on the shank 130. For example, the grinding tips 140 may be coupled to the bottom edge of the shank 130.

Coupling members 134 such as bolts may be coupled to coupling holes 124 formed in the bottom surface of the second disk 120, whereby the shank 130 can be coupled to the second disk 120.

However, a method of coupling the shank 130 to the second disk 120 is not limited to the coupling members 134 such as bolts, and thus, various methods may be used. For example, a method such as welding, press-fitting, or removable coupling may be used to couple the shank 130 to the second disk 120.

Intake recesses 126 may be formed in at least one of the second disk 120 and the shank 130 to introduce air.

Furthermore, the intake recesses 126 may have a predetermined curvature in a direction of rotation of the grinding wheel 110. For example, the intake recesses 126 may have a predetermined curvature forward in the direction of rotation of the grinding wheel 110. In this case, the amount of air introduced through the intake recesses 126 can be increased, according to the rotation of the grinding wheel 110.

One or more air intake holes 136 may be formed in the shank 130 to communicate with the intake recesses 126 and introduce air to the center of the shank 130.

As the grinding wheel 110 installed on the grinder rotates, air from the central lower portion of the grinding wheel 110 is discharged to the outside thereof through the discharge passage formed by the partitions 122, the bottom surface of the first disk 112, and the top surface of the second disk 120. Accordingly, particles produced from a grinding target can be discharged to the outside.

External air may be supplied to the central lower portion of the grinding wheel 110 through the intake recesses 126 and the air intake holes 136. Thus, even when air within the central lower portion of the grinding wheel 110 is continually discharged to the outside, a vacuum can be prevented from being formed within the central lower portion of the grinding wheel 110.

Figure 8:
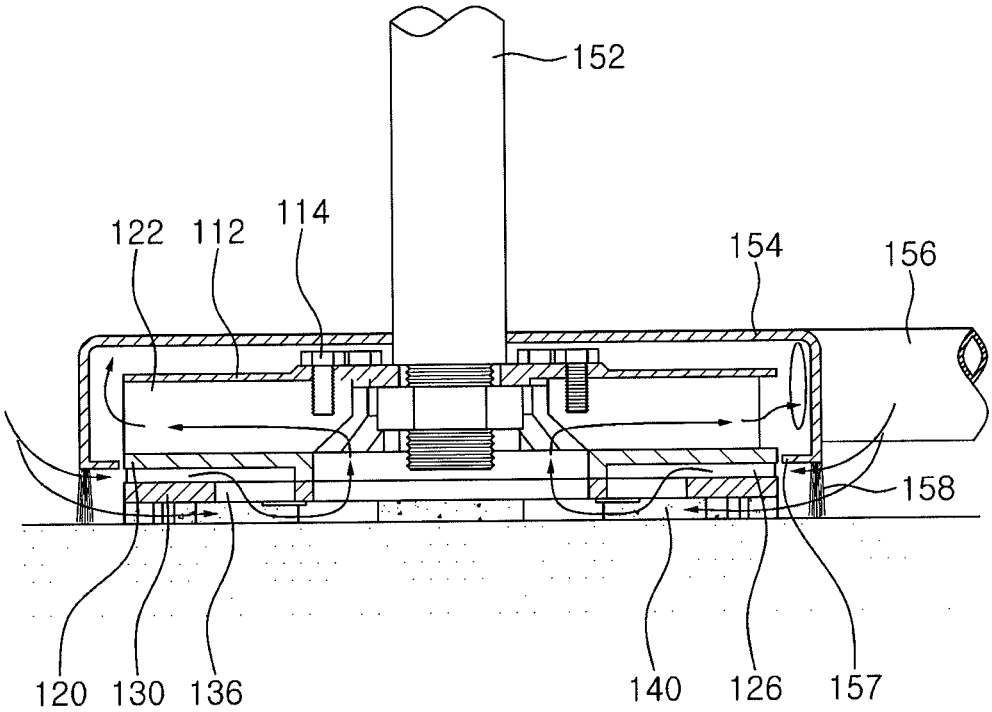
FIG. 8 is a cross-sectional view illustrating a state in which a dust cover is installed on the grinding wheel of FIG. 3.

FIG. 8 is a cross-sectional view illustrating a state in which the grinding wheel of FIG. 3 is installed on a grinder.

Referring to FIG. 8, a driving shaft 152 of the grinder may be inserted in the installation hole 113 of the grinding wheel 110.

A dust cover 154 may be provided to the grinding wheel 110 to collect grinding particles. To this end, the dust cover 154 covers outlets of the discharge passage (that is, outlets of the space formed by the partitions 122, the bottom surface of the first disk 112, and the top surface of the second disk 120).

The partitions 122 are separated from the intake recesses 126 by the dust cover 154. A particle collecting part may be disposed at a portion of the dust cover 154 to collect particles from introduced air.

For example, the particle collecting part may be adjacent to the grinder, and be connected to the dust cover 154 through a pipe 156.

According to the current embodiment, the particle collecting part may include a dust bag as a particle collecting container (not shown) disposed at a side of the grinder.

Since the grinding wheel 110 uses grinder torque to introduce and discharge air and grinding particles, a particle collector or a particle collecting fan may be unnecessary. However, a particle collector or a particle collecting fan may be provided to more efficiently intake grinding particles.

The pipe 156 connected to the dust cover 154 may be disposed at a side of the discharge passage, so that grinding particles discharged to the side of the discharge passage can be efficiently collected in the particle collecting part.

The pipe 156 may have any diameter and shape corresponding to those of the dust cover 154, and be connected to the dust cover 154 in any position. Furthermore, the pipe 156 may be provided in plural at a plurality of positions.

A protrusion member 157 may be disposed on the lower side of the dust cover 154 and may be adjacent to the grinding wheel 110, so as to cover the gap between the dust cover 154 and the grinding wheel 110.

In addition, the protrusion member 157 may separate the inside and outside of the dust cover 154 from each other, so that grinding particles discharged to the dust cover 154 through the discharge passage of the grinding wheel 110 can be prevented from being introduced into an operation space of the grinding wheel 110.

Furthermore, the protrusion member 157 may be integrally formed with the dust cover 154, or be separately formed and coupled to the dust cover 154.

A skirt 158 may be disposed on the bottom edge of the dust cover 154 to prevent grinding particles from being dispersed.

To this end, the skirt 158 may cover the space between the bottom of the dust cover 154 and a surface of a grinding target. For example, the skirt 158 may be a brush member as shown in FIG. 8, or be provided in the form of a thin sheet.

Particles produced while the grinding wheel 110 grinds a target are discharged from the central lower portion of the grinding wheel 110 to the inside of the dust cover 154 through the discharge passage.

Then, the particles discharged to the inside of the dust cover 154 are guided by the dust cover 154 to the particle collecting part through the pipe 156.

At this point, air is introduced into the central lower portion of the grinding wheel 110 through the intake recesses 126 and the air intake holes 136 so as to prevent the formation of a vacuum and provide airflow inertia, thereby discharging grinding particles more efficiently.

Figure 9:
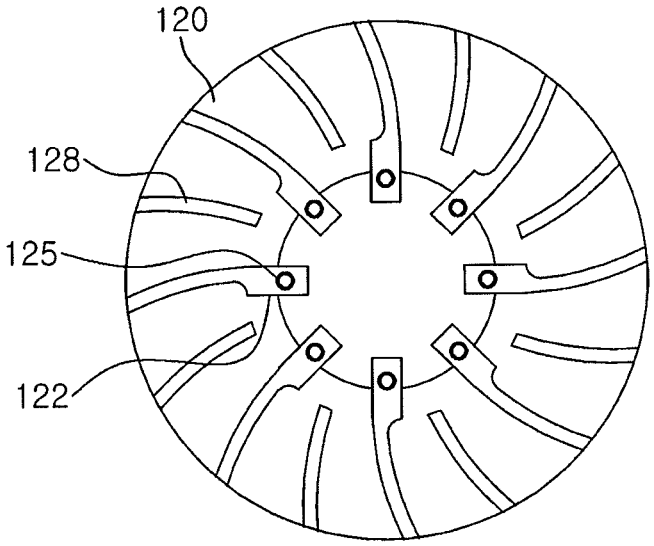
FIGS. 9(*a*) and 9(*b*) are plan views illustrating partitions of the grinding wheel of FIG. 3.
Figure 9:
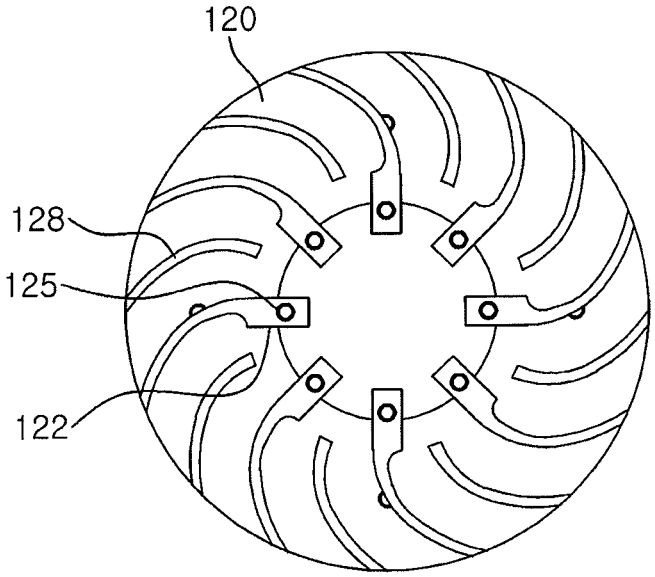

FIG. 9 is a plan view illustrating partitions of the grinding wheel of FIG. 3.

Referring to FIG. 9, the partitions 122 may have a predetermined curvature in the direction of rotation of the grinding wheel 110.

For example, the partitions 122 may be curved rearward in the direction of rotation of the grinding wheel 110. In this case, centrifugal force increases according to rotation of the grinding wheel 110, thereby discharging grinding particles more efficiently.

Auxiliary partitions 128 may be disposed between the partitions 122.

As described above, the distance between the partitions 122 may increase from the center of the second disk 120 to the edge thereof. Thus, the auxiliary partitions 128 may be disposed in expanded portions between the partitions 122. Accordingly, a plurality of the auxiliary partitions 128 and a plurality of the partitions 122 are alternately disposed.

The auxiliary partitions 128 may guide air discharged through the spaces between the partitions 122, thereby discharging grinding particles more efficiently.

The auxiliary partitions 128 may have a curvature corresponding to the curvature of the partitions 122, and extend inward from the outer edge of the second disk 120. Furthermore, the auxiliary partitions 128 may be shorter than the partitions 122.

The partitions 122 and the auxiliary partitions 128 may have a relatively small curvature in the direction of rotation of the second disk 120 as illustrated in FIG. 9(*a*), or a relatively large curvature in the direction of rotation of the second disk 120 as illustrated in FIG. 9(*b*).

As such, the curvature of the partitions 122 and the auxiliary partitions 128 may be varied according to embodiments, and the shape and position thereof may also be varied to improve performance thereof.

The grinding tips 140 are arrayed on the outer edge of the shank 130, but are not limited thereto. Thus, the grinding tips 140 may be arrayed in various formations to improve the performance thereof.

Figure 10:
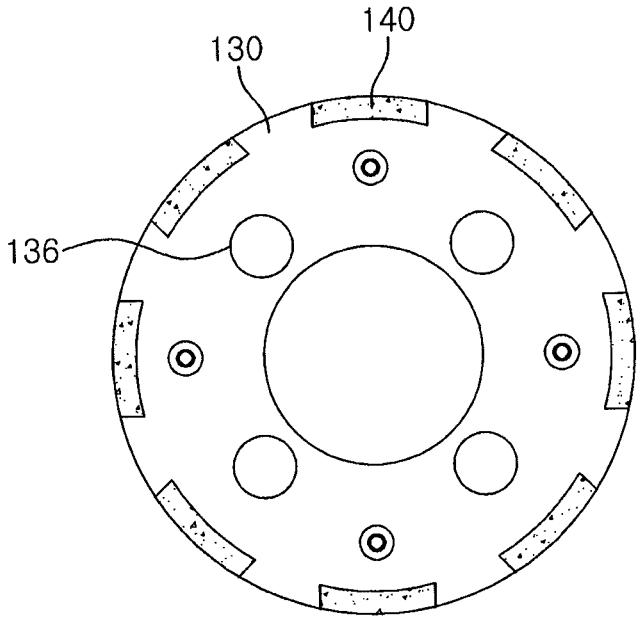
FIGS. 10(*a*) and 10(*b*) are plan views illustrating grinding tips of the grinding wheel of FIG. 3.
Figure 10:
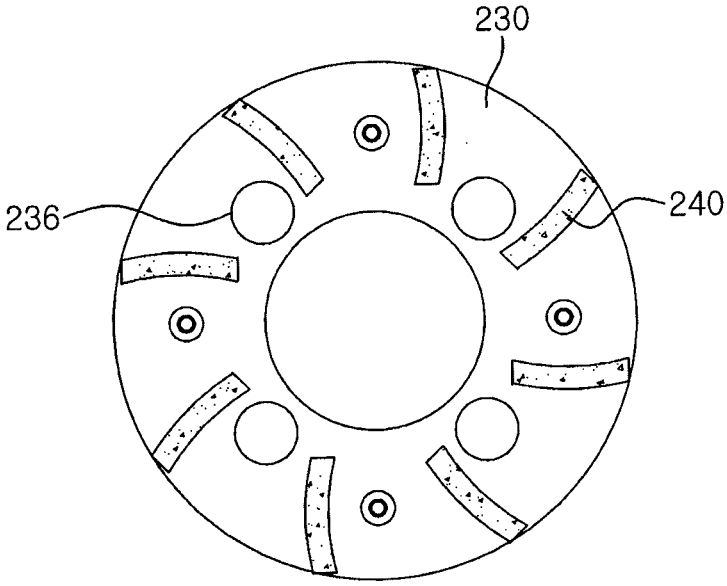

FIG. 10 is a plan view illustrating grinding tips of the grinding wheel of FIG. 3. Referring to FIG. 10(*a*), the grinding tips 140 may be arrayed along the outer bottom edge of the shank 130. In this case, the grinding tips 140 may have a curvature that is substantially the same as that of the outer circumference of the shank 130.

Alternatively, referring to FIG. 10(*b*), grinding tips 240 may have a predetermined curvature in the direction of rotation of the grinding wheel 110.

For example, the grinding tips 240 may be inclined at a certain angle on the bottom surface of a shank 230. In this case, air intake holes 236 may be disposed between the grinding tips 240 of the shank 230.

The inclination angle of the grinding tips 240 may be determined to minimize the discharge amount of grinding particles due to centrifugal force according to rotation of the grinding wheel 110.

Figure 11:
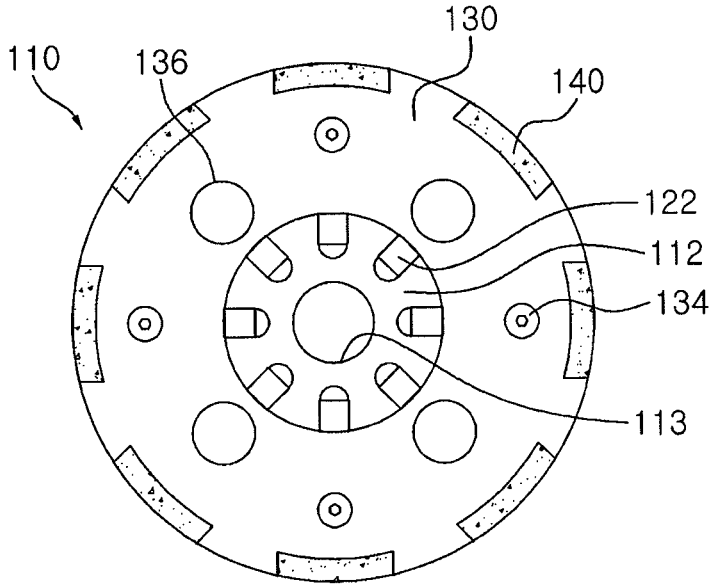
FIG. 11 is a plan view illustrating the grinding wheel of FIG. 3.

FIG. 11 is a plan view illustrating the grinding wheel of FIG. 3.

Referring to FIG. 11, the position of the intake recesses 126 correspond to the position of the air intake holes 136, but the arrangement of the intake recesses 126 and the air intake holes 136, and a communication structure thereof may be varied.

Figure 12:
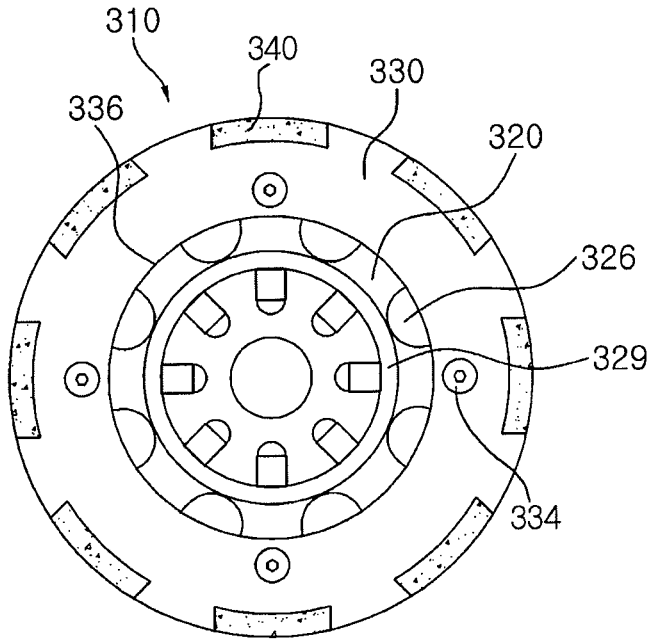
FIG. 12 is a plan view illustrating a grinding wheel according to another embodiment of the present invention.

FIG. 12 is a plan view illustrating a grinding wheel according to an embodiment of the present invention. Referring to FIG. 12, a grinding wheel 310 may have a plurality of intake recesses 326 in the bottom surface of a second disk 320.

Grinding tips 340 may be attached to a shank 330 to substantially perform a grinding operation. Coupling members 334 such as bolts may be coupled to coupling holes 124 (refer to FIG. 5) of the second disk 320, whereby the shank 330 can be coupled to the second disk 320. Alternatively, various methods such as welding, press-fitting, and removable coupling may be used to couple the shank 330 to the second disk 320.

A single air intake hole 336 is formed in the shank 330 to communicate with the intake recesses 326 and expose the intake recesses 326. The air intake hole 336 may be defined by the inner edge of the shank 330, and be formed by expanding an inner through hole of the shank 330.

The second disk 320 may include a protrusion 329 at an end of the intake recesses 326 to prevent air from being directly introduced through the inner through hole of the shank 330. The protrusion 329 may have a height sufficient to contact the bottom surface of the shank 330.

Thus, air introduced through the intake recesses 326 and the air intake hole 336 formed by expanding the inner through hole of the shank 330 may be guided downwardly by the protrusion 329, and then, be moved upwardly together with grinding particles to a discharge passage through the central portion of the grinding wheel 310.

Figure 13:
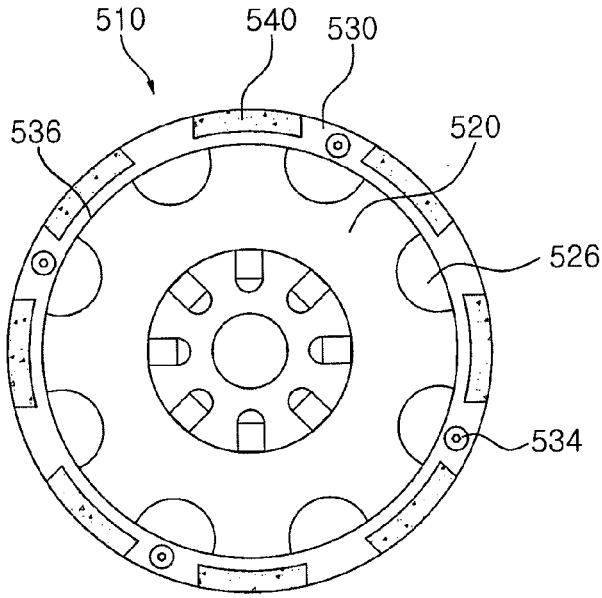
FIG. 13 is a plan view illustrating a grinding wheel according to another embodiment of the present invention.

FIG. 13 is a plan view illustrating a grinding wheel according to an embodiment of the present invention.

Referring to FIG. 13, a grinding wheel 510 may have a plurality of intake recesses 526 in the bottom surface of a second disk 520. The intake recesses 526 may be farther away from a central through hole of the second disk 520 than the intake recesses 326 of FIG. 12 is. A shank 530 may be coupled to the second disk 520. Grinding tips 540 may be provided on the shank 530 to substantially perform a grinding operation.

A large air intake hole 536 may be formed in the shank 530 to expose the intake recesses 526.

The air intake hole 536 may be solely provided to the shank 530 to communicate with the intake recesses 526 and expose the intake recesses 526.

Since the intake recesses 526 are distant from the central through hole of the second disk 520, air introduced through the intake recesses 526 is not directly introduced through the central through hole of the second disk 520, and is moved along a grinding surface to the central portion of the second disk 520.

That is, the grinding wheel 510 can circulate air without the protrusion 329 of the second disk 320 illustrated in FIG. 12.

Since the air intake hole 536 of the shank 530 is large, coupling holes 124 (refer to FIG. 5) of the second disk 520 to which coupling members 534 such as bolts are coupled can be disposed relatively distantly from the central portion of the second disk 520 to correspond to the size of the air intake hole 536. The coupling members 534 and the coupling holes 124 may be spaced apart from the grinding tips 540, for example, disposed between the grinding tips 540.

The intake recesses 526 and the air intake hole 536 communicating with the intake recesses 526 may be varied in shape, size, and position in order to effectively supply air to the central portion of the grinding wheel 510.

An operation of a grinding wheel configured as described above will now be described.

First, the grinding wheel 110 is installed on the driving shaft 152 of the grinder.

At this point, the driving shaft 152 is inserted into the installation hole 113 of the first disk 112, and then, is fixed to the first disk 112 by a coupling member such as a nut.

Then, power is supplied to operate the grinder, and the driving shaft 152 rotates to thereby rotate the grinding wheel 110. Accordingly, that the grinding wheel 110 can rub and grind a target.

Substantially, the grinding tips 140 attached to the shank 130 grind the target. At this point, grinding particles are produced from the target.

The grinding particles produced from the target are intaken upward through the central portion of the shank 130 to the discharge passage formed by the partitions 122, the first disk 112, and the second disk 120, and then, are discharged to the outside.

At this point, external air is introduced into the grinding wheel 110 through the intake recesses 126 of the second disk 120 and the air intake holes 136 of the shank 130. Accordingly, the formation of a vacuum is prevented, and airflow inertia is provided to air including the grinding particles intaken into the discharge passage (that is, into the space formed by the partitions 122, the first disk 112, and the second disk 120), thereby discharging the grinding particles more efficiently.

In addition, since the grinding particles are removed from the grinding wheel 110, friction between grinding particles and air within the grinding wheel 110 is removed, and the amount of air introduced into the grinding wheel 110 is increased.

Thus, frictional load applied to the grinding wheel 110 is decreased, and cooling efficiency of the grinding wheel 110 is improved, thereby increasing grinding efficiency and durability of the grinding wheel 110, and improving grinding quality of the target.

Furthermore, the grinding particles produced while the target is ground can be efficiently collected into the dust cover 154 disposed at the outlets of the discharge passage.

In addition, the protrusion member 157 minimizes the amount of grinding particles dispersed from the inside of the dust cover 154 to the outside thereof, and grinding particles collected in the dust cover 154 are introduced through the pipe 156 into the particle collecting part connected to a side portion of the dust cover 154.

Figure 14:
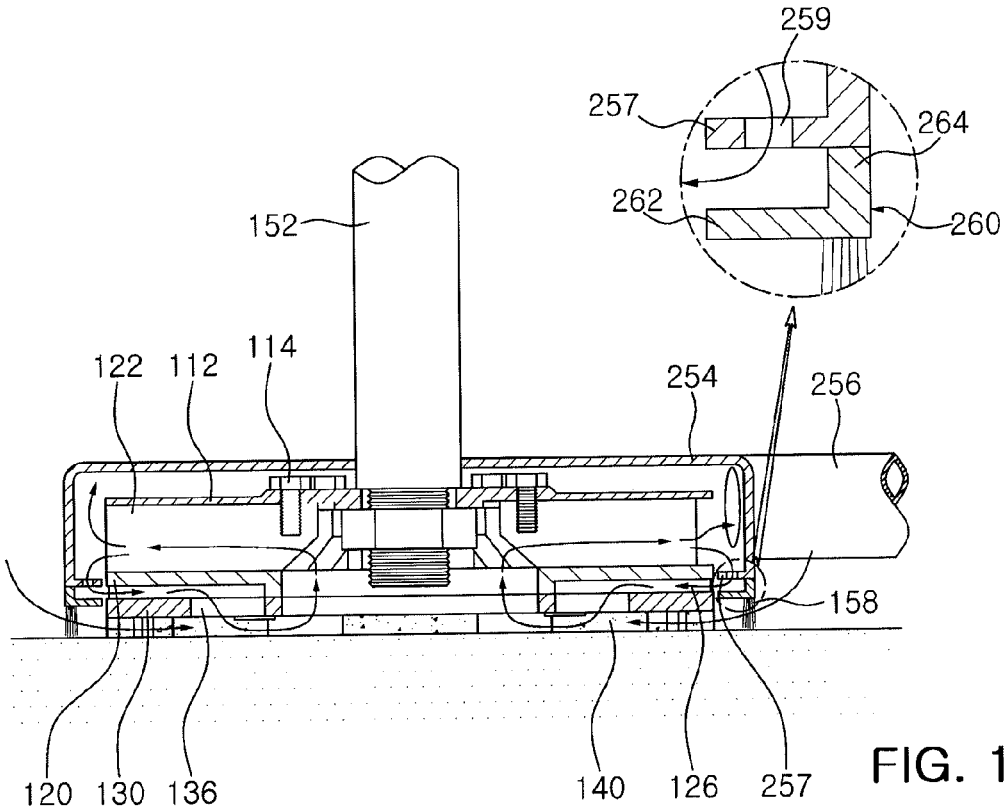
FIG. 14 is a cross-sectional view illustrating a state in which a dust cover is installed on a grinding wheel, according to another embodiment of the present invention.

FIG. 14 is a cross-sectional view illustrating a state in which a grinding wheel is installed on a grinder, according to an embodiment of the present invention.

Referring to FIG. 14, a dust cover 254 may cover the outlets of the discharge passage.

The dust cover 254 may include a guide cover 260 to cover the intake recesses 126.

The guide cover 260 may be disposed at the lower end of the dust cover 254, e.g., under a protrusion member 257.

Furthermore, the guide cover 260 may be integrally formed with the dust cover 254, or be separately formed and coupled to the dust cover 254 or the protrusion member 257. To this end, a coupling member may be used. Alternatively, various methods such as welding, press-fitting, and removable coupling may be used to couple the guide cover 260 to the dust cover 254 or the protrusion member 257.

The guide cover 260 may include a flange 262 disposed on an imaginary plane under the intake recesses 126, and form a certain space with a stepped protrusion 264 disposed between the flange 262 and the protrusion member 257 as a lower portion of the dust cover 254.

For example, the guide cover 260 may have an L shape formed by the stepped protrusion 264 and the flange 262.

A lower portion of the dust cover 254, e.g., a portion of the protrusion member 257 may be provided with a hole 259 through which a portion of air discharged from the discharge passage is introduced into the space formed by the guide cover 260.

Thus, while air is discharged from the discharge passage to a pipe 256 connected to the dust cover 254, a portion of the discharged air may collide with an inner wall of the dust cover 254, and then be forcibly introduced through the hole 259 to the space formed by the guide cover 260. Then, the air forcibly introduced into the space formed by the guide cover 260 may be introduced into the central portion of the grinding wheel 110 through the intake recess 126, thereby preventing the formation of a vacuum within the grinding wheel 110.

According to an embodiment of the present invention, air intaken from the central lower portion of a grinding wheel is discharged to the outside of the grinding wheel through a discharge passage, thereby efficiently collecting grinding particles produced from a grinding target. Thus, the amount of grinding particles discharged to the surrounding area of a working site can be minimized, and grinding particles can be prevented from contacting the human body.

In addition, grinding particles can be intaken using torque of a power tool without using additional power, and particle collecting efficiency can be optimized.

In addition, the particle collecting efficiency can be improved by adjusting an angle of partitions forming the discharge passage.

As such, particles produced from a grinding target can be efficiently collected and discharged so as to prevent residual particles from degrading grinding efficiency and wearing grinding tips, thereby improving durability thereof. In addition, load applied to a grinder is decreased to reduce power required for a grinding operation.

In addition, air can be intaken into the central portion of the grinding wheel to prevent the formation of a vacuum within the central portion, thereby discharging grinding particles without delay, and collecting grinding particles more efficiently.

In addition, since air can be efficiently introduced into the grinding wheel, inner grinding wheel temperature can be decreased, thereby reducing thermal damage to the grinding tips.

In addition, a portion of air discharged to a dust cover is forcibly introduced into the grinding wheel through holes, thereby efficiently intaking air, and thus continually and stably supplying air to the central portion of the grinding wheel as a grinding tool.

While the present invention has been shown and described in connection with the exemplary embodiments, it will be apparent to those skilled in the art that modifications and variations can be made without departing from the spirit and scope of the invention as defined by the appended claims.

What is claimed is:

1. A grinding tool for being installed on a grinder, the grinding tool comprising:

a first disk having an installation hole in a center portion thereof for enabling installation of the grinding tool on the grinder;

a second disk forming a discharge passage with partitions on a bottom surface of the first disk, wherein air intaken from a central lower portion of the grinding tool is discharged to an outside thereof through the discharge passage; and a ring-shaped shank disposed under the second disk and comprising grinding tips to grind a target.

2. The grinding tool of claim 1, further comprising an intake recess in at least one of the second disk and the shank to take air in, wherein the shank has at least one air intake hole that communicates with the intake recess to introduce the air to the central portion of the grinding tool.

3. The grinding tool of claim 2, wherein the intake recess has a predetermined curvature in a direction of rotation of the grinding tool.

4. The grinding tool of claim 3, further comprising an auxiliary partition between the partitions.

5. The grinding tool of claim 3, further comprising a dust cover that covers an outlet of the discharge passage and separates the outlet of the discharge passage from the intake recess.

6. The grinding tool of claim 5, further comprising a particle collecting part that communicates with a side portion of the dust cover.

7. The grinding tool of claim 5, wherein the dust cover comprises a guide cover to cover the intake recess, and has holes in a portion thereof such that a portion of air discharged from the discharge passage is introduced into a space formed by the guide cover.

8. The grinding tool of claim 2, further comprising an auxiliary partition between the partitions.

9. The grinding tool of claim 2, further comprising a dust cover that covers an outlet of the discharge passage and separates the outlet of the discharge passage from the intake recess.

10. The grinding tool of claim 9, further comprising a particle collecting part that communicates with a side portion of the dust cover.

11. The grinding tool of claim 9, wherein the dust cover comprises a guide cover to cover the intake recess, and has holes in a portion thereof such that a portion of air discharged from the discharge passage is introduced into a space formed by the guide cover.

12. The grinding tool of claim 1, wherein the partition has a predetermined curvature in a direction of rotation of the grinding tool.

13. The grinding tool of claim 12, further comprising an auxiliary partition between the partitions.

14. The grinding tool of claim 1, wherein the grinding tips have a predetermined curvature in a direction of rotation of the grinding tool.

15. The grinding tool of claim 14, further comprising an auxiliary partition between the partitions.

16. The grinding tool of claim 1, further comprising an auxiliary partition between the partitions.

* * * * *